United States Patent [19]

Widiner et al.

[11] 4,379,657

[45] Apr. 12, 1983

[54] RISER TENSIONER

[75] Inventors: Karl J. Widiner, Carpinteria, Calif.; Riley G. Goldsmith, Houston, Tex.

[73] Assignee: Conoco Inc., Ponca City, Okla.

[21] Appl. No.: 161,235

[22] Filed: Jun. 19, 1980

[51] Int. Cl.[3] ..... B63B 35/44

[52] U.S. Cl. ..... 405/195; 405/303

[58] Field of Search ..... 405/195, 303, 196–206, 405/168, 169, 170; 166/350, 359, 367; 114/256; 175/5–10

[56] References Cited

U.S. PATENT DOCUMENTS

| | | | |
|---|---|---|---|
| 2,841,961 | 7/1958 | Lucas | 405/203 X |
| 3,171,259 | 3/1965 | Roussel | 405/199 |
| 3,378,086 | 4/1968 | Kivisld | 175/7 |
| 3,718,316 | 2/1973 | Larralde et al. | 254/172 |
| 3,955,621 | 5/1976 | Webb | 175/7 |
| 4,004,532 | 1/1977 | Reynolds | 114/256 |
| 4,121,806 | 10/1978 | Iato et al. | 254/172 |
| 4,142,584 | 3/1979 | Brewer | 175/7 X |
| 4,213,720 | 7/1980 | Portass | 405/195 |

OTHER PUBLICATIONS

Vetco Offshore, Inc., Catalog, pp. 5890, 5891.

ETA Chapter from "The Technology of Offshore Drilling", Completion and Production, Compiled by ETA Offshore Seminars, Inc.

*Primary Examiner*—Dennis L. Taylor

*Attorney, Agent, or Firm*—Stephen A. Littlefield

[57] ABSTRACT

A modular riser tensioner has a frame (10) for mounting on a platform deck with air (16,18) and oil (20,22) accumulators mounted on a mounting frame and connected to cylinders (24–30) also on the mounting frame. A piston (32) located within the cylinders carries a riser tensioning ring (50) for supporting the riser. Pairs of cylinders are located on opposite sides of the riser and connected to an oil accumulator independent of the other cylinders.

2 Claims, 2 Drawing Figures

RISER TENSIONER

BACKGROUND OF THE INVENTION

The invention relates to offshore oil production and in particular to a modular apparatus for tensioning production risers to a floating platform.

In the production of oil to a tensioned leg floating platform a conductor or riser has its lower end secured to a connection at the seabed. The upper end of the riser is terminated at the platform. The marine riser will collapse if not partially or completely supported at the upper end. It, therefore, is conventionally supported by a tensioned forced applied at the upper end of the riser.

Because of the relative motion between the platform and the seabed caused by wave and tide actions, some device is required to maintain the tension while permitting the relative motion.

This has conventionally been accomplished on other types of floating vessels with hydraulic-pneumatic tensioning devices mounted on the vessel structure and connected to the riser with a plurality of wire ropes. The conventional method requires considerable deck space and makes changing of tensioners between various locations difficult and impracticable for floating platform use. The wire rope requires constant maintenance, is subject to wear with potential failure, and the use of the rope delays the response time of the tensioning system.

SUMMARY OF THE INVENTION

A modular riser tensioner for supporting a riser from a floating platform includes a mounting frame which has means for supporting the frame from the platform, and which has a central opening. A riser tensioning ring, also having a central opening, includes a means for supporting a riser therewithin. At least four vertical cylinders and corresponding pistons are located equally spaced around the central opening. Pairs of opposing cylinders are manifolded to corresponding oil accumulators which are in turn manifolded to corresponding air accumulators. The cylinder and the accumulators are connected and supported on either the mounting frame or the riser tensioning ring. The piston is connected to the other of the supporting frame or riser tensioning ring.

Accordingly, the invention comprises a portable, compact modular structure carrying the accumulator cylinders as a part of the frame. The apparatus has a faster response time than the type using wire rope and does not have the problems of rope wear and breakage. It is a relatively small modular unit which may be readily moved for use at various locations and easily interchanged. The elements contribute to a long operational life with a minimum of maintenance.

DESCRIPTION OF THE PREFERRED EMBODIMENT

Figure 1:
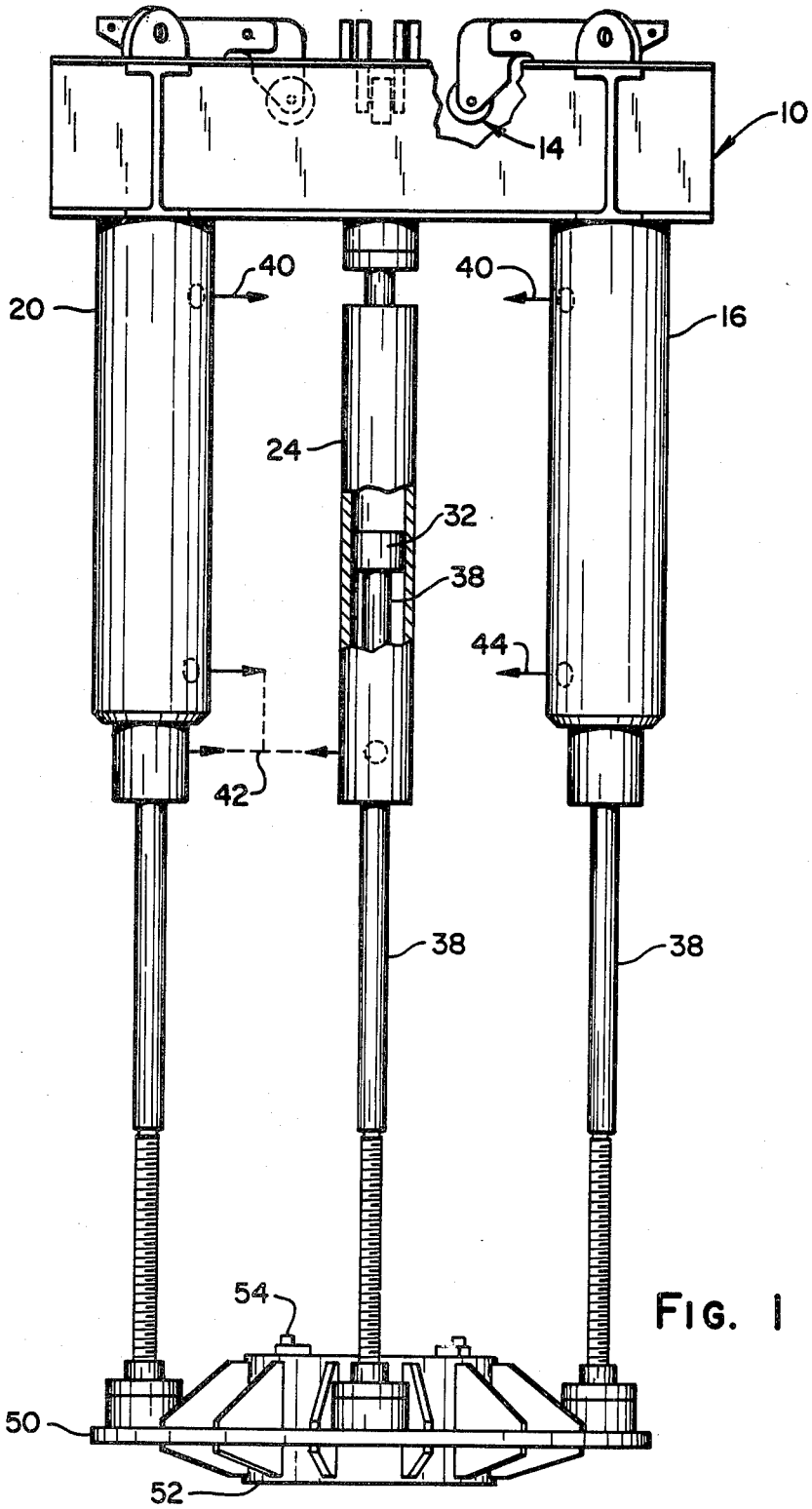
FIG. 1 is a side elevation of the tensioner.
Figure 2:
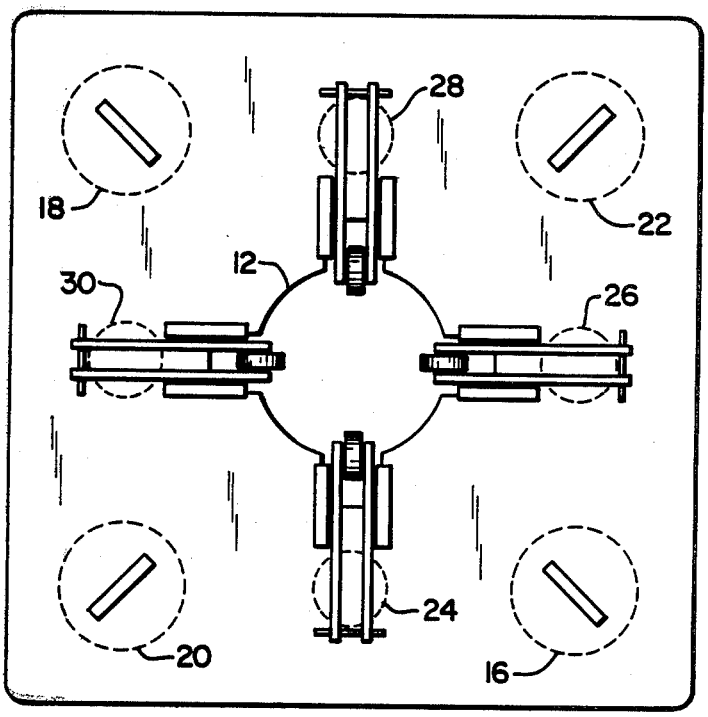
FIG. 2 is a plan view of the riser.

A tensioned leg platform has in its deck a square recessed opening, not shown. The modular tensioner has a generally square mounting frame 10 which is peripherally supported by the deck and which has a central opening 12 in which the riser to be supported is located. The frame also includes centralizing rollers 14 which are spring loaded and operate simply to maintain the riser centrally within the opening.

Two air accumulators 16 and 18 are mounted on the bottom of the mounting frames as are two oil accumulators 20 and 22. Also directly connected to the mounting frame are four cylinders 24, 26, 28, and 30.

Located within each of the cylinders is a corresponding piston 32 with a piston rod 38 attached thereto and with the rod end of the cylinder being sealed against the rod.

An interconnecting pipe 40 connects the upper end of oil accumulator 20 and air accumulator 16. A corresponding line interconnects accumulators 18 and 22. A second interconnecting pipe 42 connects the bottom of oil accumulator 20 with cylinders 24 and 28 with the connection to the cylinders being on the rod side of the piston.

A charging connection 44 is located in each of the air accumulators to permit intermittent charging of the system from an external air pressure source, not shown. The amount of load to be carried is varied by charging the air accumulator up to a necessary pressure with the system acting as a pneumatic spring thereafter. The air pressure acting through the oil accumulator forces oil into the rod side of piston 32 thereby supporting a load which is a function of the pressure existing within the system.

The accumulators 18 and 22 are connected in a corresponding manner to cylinders 26 and 30. It can be seen that a single accumulator is connected to cylinders located on opposite sides of the riser and, accordingly, both cylinders must operate at identical pressures. This prevents uneven loading on the two sides exerting a bending moment on the riser. Furthermore, should either of the systems be out of operation, the remaining system can carry the load by increasing the pressure within the active air accumulator system.

The rods 38 of the piston are extended downwardly and are directly connected to a riser tensioning ring 50. This ring includes a central opening 52 and locking dogs 54 which engage and support a riser system passing through the central opening.

The riser tensioner is modular and fits readily within a compatible opening within the deck. The frame 10 carries with it the accumulators 16, 18, 20, and 22 as well as the support cylinders. The modular unit includes the pistons and piston rods 38 which support the riser tensioning ring thereby providing a compact modular unit requiring no wire rope or support. The only connection to on-deck equipment is intermittent connection required for charging of the air accumulators when required.

We claim:

1. A portable modular riser tensioner for supporting risers from a floating platform comprising: a mounting frame having peripheral supports for supporting said frame from the platform and a central opening; a riser tensioning ring having a central opening and means for supporting a riser within said central opening of said riser tensioning ring; at least two pairs of cylinders, one of each of said pair of cylinders being diametrically opposed to the other of said pair; a piston having a rod end slideable in each of said cylinders; at least two oil accumulators; at least two air accumulators; said cylinders, said oil accumulators and said air accumulators all connected to one of said mounting frame and said tensioning ring; said piston connected to the other of said mounting frame and said tensioning ring through said rod ends; an upper portion of each of said air accumulators in fluid communication with an upper portion of a corresponding oil accumulator; and a lower end of an oil accumulator in fluid communication with a corresponding pair of said diametrically opposed cylinders at the rod end of said piston.

2. A modular riser tensioner as in claim 1 wherein said cylinders are connected to said mounting frame.

* * * * *